US006945814B2

(12) United States Patent
Snape et al.

(10) Patent No.: US 6,945,814 B2
(45) Date of Patent: Sep. 20, 2005

(54) MULTI-POSITION ELECTRICAL CONNECTOR FOR ROBOTIC TOOL CHANGER

(75) Inventors: James Snape, Raleigh, NC (US); Robert Little, Apex, NC (US)

(73) Assignee: ATI Industrial Automation, Inc., Apex, NC (US)

( * ) Notice: Subject to any disclaimer, the term of this patent is extended or adjusted under 35 U.S.C. 154(b) by 0 days.

(21) Appl. No.: 10/748,349

(22) Filed: Dec. 30, 2003

(65) Prior Publication Data

US 2005/0142931 A1 Jun. 30, 2005

(51) Int. Cl.[7] ..... H01R 13/60; H01R 35/00
(52) U.S. Cl. ..... 439/534; 439/165; 439/777
(58) Field of Search ..... 439/534, 11, 13, 439/261, 33, 341, 372, 165, 954, 777; 901/28

(56) References Cited

U.S. PATENT DOCUMENTS 1,649,951 A * 11/1927 English ..... 403/96
3,066,277 A * 11/1962 Edmunds ..... 439/777
4,544,215 A * 10/1985 Fritsch ..... 439/13
4,959,021 A * 9/1990 Byrne ..... 439/310
5,022,861 A * 6/1991 Aoto ..... 439/13
5,281,761 A * 1/1994 Woo et al. ..... 174/78
5,681,171 A * 10/1997 Park ..... 439/31
6,093,028 A * 7/2000 Yang ..... 439/13
6,213,782 B1 * 4/2001 Derstine ..... 439/31
6,821,134 B2 * 11/2004 Chen ..... 439/131

* cited by examiner

*Primary Examiner*—Hae Moon Hyeon
(74) *Attorney, Agent, or Firm*—Coats & Bennett, P.L.L.C.

(57) ABSTRACT

A multi-position electrical connector for a robotic tool changer includes a bracket mountable to a robotic tool changer master or tool module, a coupling interface in a fixed position with respect to the bracket, and a cable interface moveable to a plurality of positions with respect to the bracket. Both the coupling interface and the cable interface include a plurality of electrical contacts, which are electrically connected. In one embodiment, the cable interface is disposed at substantially 90 degrees to the coupling interface, and is rotatable about an axis of the coupling interface. The cable interface may be fixed in one of a plurality of positions around the coupling interface. In one embodiment, a selected position is fixed by mating a retention member on one of the cable interface and the bracket, with a recess on the other of the cable interface and the bracket.

23 Claims, 6 Drawing Sheets

MULTI-POSITION ELECTRICAL CONNECTOR FOR ROBOTIC TOOL CHANGER

BACKGROUND

The present invention relates generally to the field of robotics and specifically to a multi-position electrical connector for the master and/or tool modules of a robotic tool changer.

Industrial robots have become an indispensable part of modern manufacturing. Whether transferring semiconductor wafers from one process chamber to another in a cleanroom or cutting and welding steel on the floor of an automobile manufacturing plant, robots perform many manufacturing tasks tirelessly, in hostile environments, and with high precision and repeatability.

In many robotic manufacturing applications, it is cost-effective to utilize a relatively generic robot to accomplish a variety of tasks. For example, in an automotive manufacturing application, a robot may be utilized to cut, grind, or otherwise shape metal parts during one production run, and perform a variety of spot welding tasks in another. Different welding tool geometries may be advantageously mated to a particular robot to perform welding tasks at different locations or in different orientations. In these applications, a tool changer is used to mate different tools to the robot. One half of the tool changer, called the master module, is permanently affixed to a robot arm. The other half, called the tool module, is affixed to each tool that the robot may utilize. When the robot arm positions the master module adjacent the tool module connected to a desired tool, a coupler is actuated that mechanically locks the master and tool modules together, thus affixing the tool to the end of the robot arm. Tool changers and their constituent couplers are well known in the robotics arts, and are commercially available, such as from the assignee, ATI Industrial Automation of Apex, N.C.

Many robotic tool changers include features to pass utilities—such as electrical current, air pressure, hydraulic fluid, cooling water, electronic or optical data signals, and the like—through the robot changer from the master module to the tool module and vice versa, via mating terminals, valve connections, electrical connectors, and the like, thus making the utilities available to the selected tool.

The wide variety of tools that may be connected to a robot arm may impose different space constraints on the placement of such utility couplings, and the concomitant routing of conduits such as wires, hoses, and the like. Other constraints on coupling placement and conduit routing may be imposed by environmental conditions created when the tool is operative, such as excessive heat, electromagnetic interference, and the like.

In response to customer demands spawned by such constraints, robotic tool changers have developed an array of differently configured utility couplings. For example, ATI Industrial Automation provides a variety of multi-conductor electrical connectors that transfer electrical signals across the master/tool interface. These connectors provide a consistent master/tool interface configuration, but locate their cable interfaces in a variety of different directions, e.g., straight-through, at a right-hand 90 degree angle, at a left-hand 90 degree angle, and the like. While the variety of electrical connector configurations allows customers to route their electrical cables conveniently, it increases the complexity of configuring a robot changer for a given application, increases inventory, and makes changing a given installed configuration problematic, as the connectors often must be changed to accommodate a different desired cable routing.

SUMMARY

The present invention relates to a multi-position electrical connector for a robotic tool changer. The connector includes a bracket mountable to a robotic tool changer master or tool module, a coupling interface in a fixed position with respect to the bracket, and a cable interface moveable to a plurality of positions with respect to the bracket. Both the coupling interface and the cable interface include a plurality of electrical contacts, which are electrically connected. In one embodiment, the cable interface is disposed at substantially 90 degrees to the coupling interface, and is rotatable about an axis of the coupling interface. The cable interface may be fixed in one of a plurality of positions around the coupling interface. In one embodiment, a selected position is fixed by mating a retention member on one of the cable interface and the bracket, with a recess on the other of the cable interface and the bracket.

DETAILED DESCRIPTION OF THE INVENTION

Figure 5:
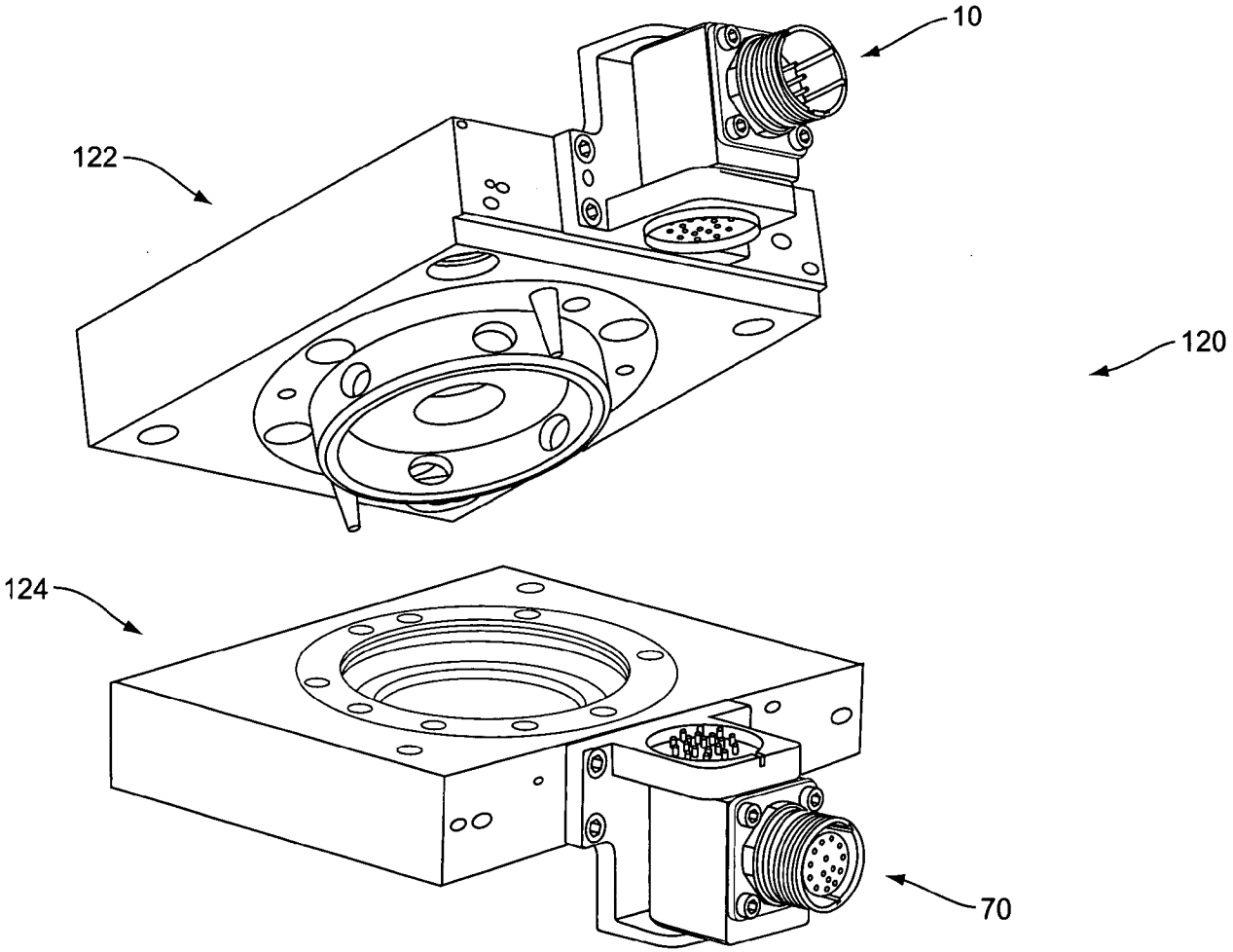
FIG. 5 is a perspective view of a robotic tool changer with master and tool electrical connectors attached.

The present invention relates to a multi-position electrical connector for a robotic tool changer. Robotic tool changers are well known in the art. A representative robotic tool changer is depicted in FIG. 5, and indicated generally by the number 120. A master module 122, including a multi-position master electrical connector 10 is typically affixed to the end of a robot arm (not shown). A tool module 124, including a multi-position tool electrical connector 70, is typically attached to a robotic tool (not shown). The robot arm may then be removably coupled to the robotic tool. The master electrical connector 10 and tool electrical connector 70 are affixed to the master module 122 and tool module 124, respectively, such that when the master module 122 couples to the tool module 124, an electrical connection is established between the master electrical connector 10 and the tool electrical connector 70. Electrical cables (not shown) are attached to the master and tool electrical connectors 10 and 70.

Figure 1:
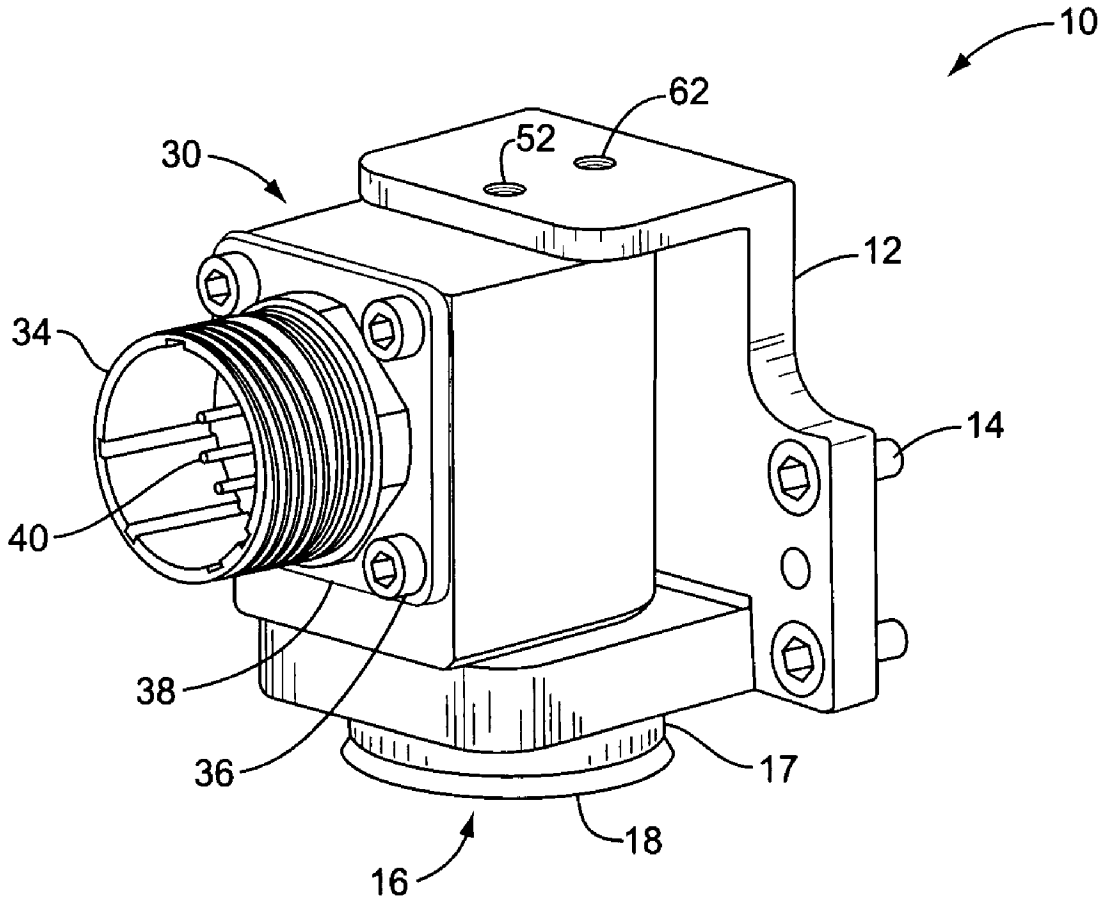
FIG. 1 is a perspective view of a master electrical connector.
Figure 2:
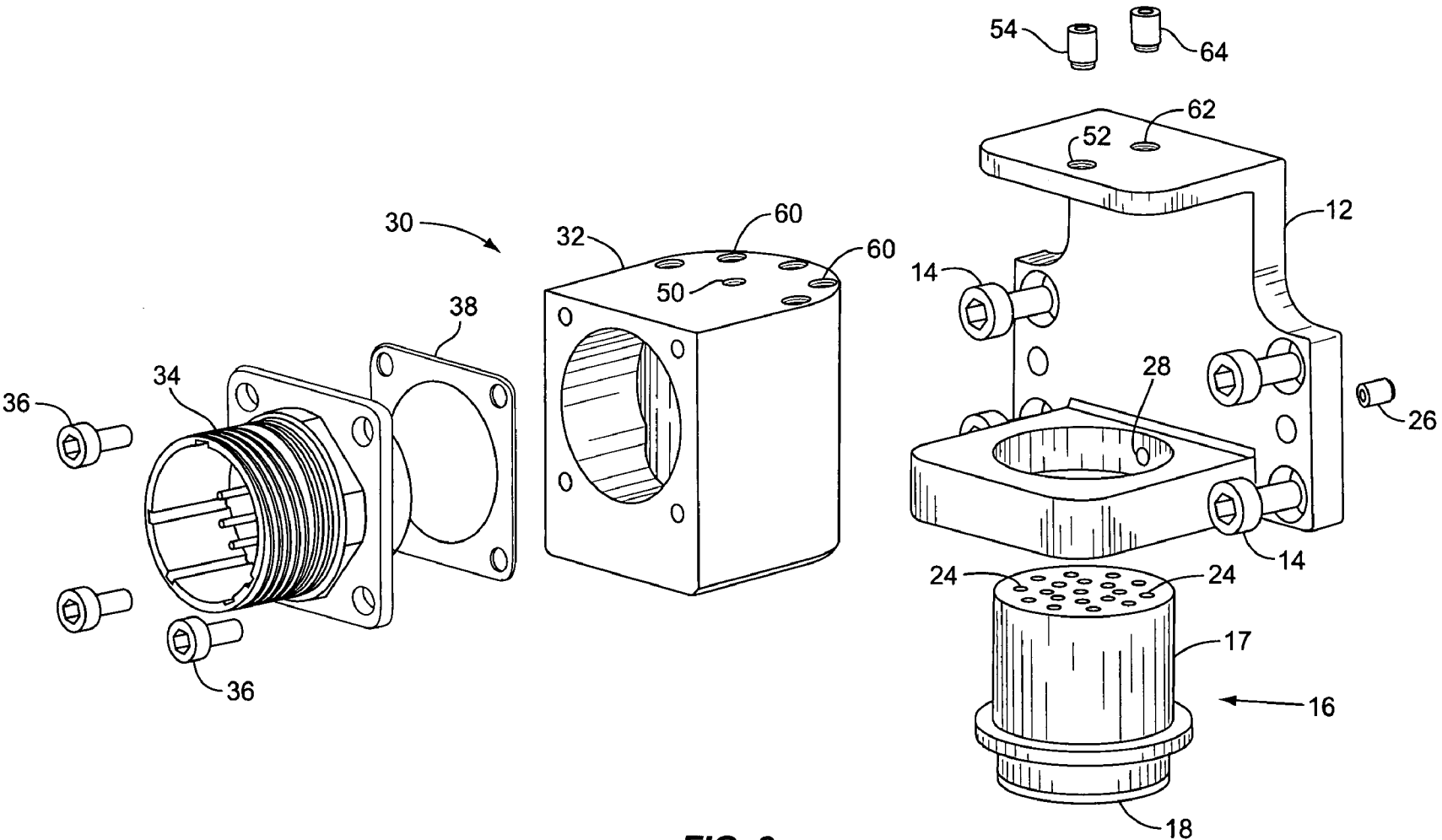
FIG. 2 is an exploded perspective view of the components comprising a master electrical connector.
Figure 3:
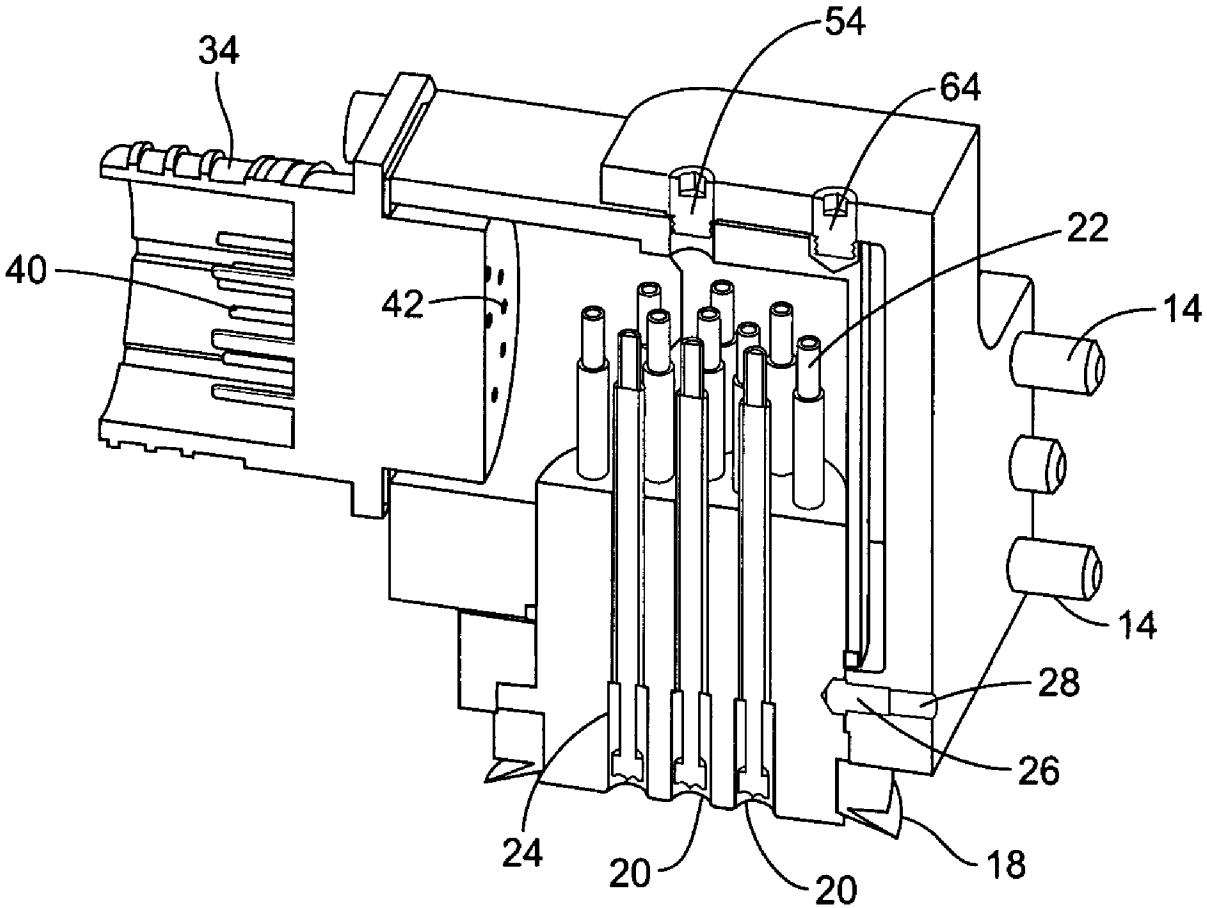
FIG. 3 is a section view of a master electrical connector.

The multi-position master electrical connector 10 is depicted in perspective view in FIG. 1, in exploded perspective view in FIG. 2, and in section view in FIG. 3. Component parts are numbered consistently across all three views. The master electrical connector 10 comprises a bracket 12 that is connected to a tool changer master module 122 by fasteners 14, a coupling interface 16, and a cable interface 30. The coupling interface 16 is fixed with respect to the bracket 12, and the cable interface 30 is moveable to a plurality of positions with respect to the bracket 12.

The coupling interface 16 provides a multi-signal electrical interface to a mating electrical connector affixed to a tool module 124. The coupling interface 16 comprises a generally cylindrical pin block 17, with a plurality of pin holes 24 formed therethrough in an axial direction. The pin holes 24 contain conductive pins 22, with electrical contacts 20 at an external end thereof. Contacts 20 may be spring-loaded or otherwise deformable, as known in the art. A deformable boot 18 protects the contacts 20 and the mating contacts of a tool electrical connector when the master module 122 and tool module 124 of a tool changer 120 are coupled together. The coupling interface 16 is disposed within the bracket 12, and held in a fixed position by a retention member, such as set screw 26 inserted in threaded through-hole 28.

The cable interface 30 comprises a rotatable block 32 and a cable connector 34. The cable connector 34 is affixed to the rotatable block 32 by a plurality of fasteners 36, with an intervening rubber gasket 38 providing a moisture seal. The cable connector 34 includes a plurality of pins 40 disposed in pin holes 42. The protruding pins 40 may double as electrical contacts for the cable connector 34.

A plurality of flexible wires (not shown) connects the coupling interface electrical pins 22 with the cable interface electrical pins 40. Generally, each pin 22 is connected to a different pin 40, to transfer a plurality of distinct electrical signals between the coupling interface contacts 20 and the cable connector contacts 40. However, one or more pins 22 may be electrically connected to a plurality of pins 40, and vice versa, as well known in the art.

As best depicted in FIG. 3, the master electrical connector 10 is assembled by positioning the rotatable block 32 of the cable interface 30 into the bracket 12. The cylindrical pin block 17 of the coupling interface 16 is then inserted into the rotatable block 32, such that the rotatable block 32 is free to pivot or rotate about the cylindrical pin block 17 (which is fixed with respect to the bracket 12 by set screw 26).

The rotatable pin block 32 is held in a rotatable position at the lower end thereof (with respect to the orientation of FIGS. 1, 2, and 3) by the cylindrical pin block 17. The rotatable block 32 is secured in a rotatable position with respect to the bracket 12 at the upper end thereof by a retention member, such as set screw 54 disposed in threaded through-hole 52 of the bracket 12 and mating with recess 50, located on rotatable block 32 on the axis of rotation thereof.

While the cable interface 30 may rotate within the bracket 12 through approximately 180° of rotation about the cylindrical pin block 17, safety and reliability concerns dictate that the cable interface 30 be secured during use in one of a plurality of positions within its range of rotation. This is achieved by a retention member in the bracket 12 engaging one of a plurality of position-fixing recesses 60 disposed about the periphery of the rotatable block 32. In the embodiment depicted, the retention member is a set screw 64 disposed in a threaded-through hole 62. In operation, the set screw 64 is retracted to allow the rotatable block 32 to pivot about the cylindrical pin block 17 and the retention member 54 engaging the axial recess 50. Upon selecting the desired predetermined position for the cable interface 30 with respect to the bracket 12, the retention member 64 is actuated to mate with the selected position-fixing recess 60 to fix the position of the rotatable block 32.

While the embodiment depicted in FIGS. 1–3 employs set screws 54, 64 for retention members, those of skill in the art will readily recognize that alternative means of engaging the recesses 50, 60 are readily available, and within the scope of the present invention. For example, the set screw 64 may be replaced by the actuating rod of a solenoid, or other means as appropriate or desired.

Additionally, fixing the position of the cable interface 30 with respect to the bracket 12 may be accomplished with a single position-fixing recess 60 formed along the periphery of the rotatable block 32, and a plurality of threaded through-holes 62 (or other means of positioning a position-fixing retention member 64) formed in an arc in the bracket 12. In this case, the cable interface 30 would be rotated in the bracket 12 to the desired position, aligning the single position-fixing recess 60 with the desired through-hole 62, and inserting the retention member 64 into the selected through-hole 62, to engage with the recess 60. Still other means of fixing the cable interface 30 in a desired position of rotation with respect to the bracket 12, as may be readily devised of one of ordinary skill in the art without undue experimentation, are within the scope of the present invention.

Figure 4:
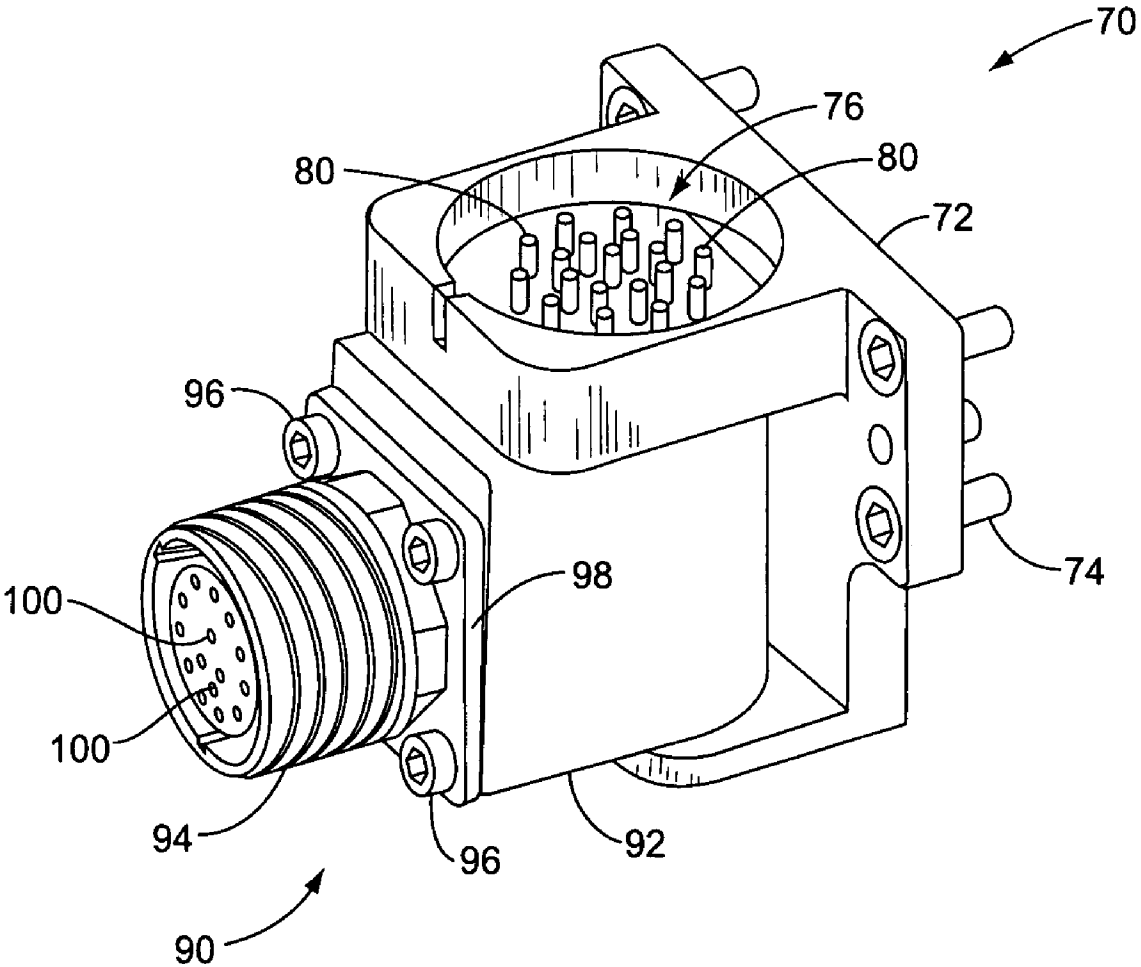
FIG. 4 is a perspective view of a tool electrical connector.

FIG. 4 depicts a tool electrical connector 70 according to one embodiment of the present invention. The tool electrical connector 70 is substantially similar to the master electrical connector 10, with the various components oriented so as to provide connectivity when the tool electrical connector 70 is affixed to a tool module 124 of a robotic tool changer 120. The tool electrical connector 70 includes a bracket 72 secured to the tool module 124 by fasteners 74, a coupling interface 76 and a cable interface 90. The coupling interface 76, which includes a plurality of pins 80, is fixed with respect to the bracket 72. The cable interface 90 is moveable to a plurality of positions with respect to the bracket 72.

The cable interface 90 comprises a rotatable block 92 and cable connector 94. The cable connector 94 is secured to the rotatable block 92 by fasteners 96 with an intervening rubber gasket 98. The cable connector 94 includes electrical contacts 100, which are electrically connected to, and may comprise part of, electrical pins (not shown) extending through the cable connector 94. The electrical contacts 80 of the coupling interface 76 are each connected to an electrical contact 100 of the cable interface 90.

On the underside of the tool electrical connector 70 (with respect to the orientation depicted in FIG. 4), retention members (not shown) secure the rotatable block 92 at the axis of rotation and at a selectable position-fixing recess (not shown) located along the periphery of the rotatable block 92, to fix the cable connector 90 in one of a plurality of predetermined positions with respect to the bracket 72, in a manner directly analogous to that described above with respect to the master tool connector 10.

FIG. 5 depicts a tool changer 120 comprising a master module 122 and a tool module 124. The master module is depicted with a master tool electrical connector 10 according to the present invention affixed thereto. Similarly, the tool module 124 is depicted with a tool electrical connector 70 according to the present invention affixed thereto. It is noted that either the master electrical contact 10 or the tool electrical contact 70, or both, may be attached to a tool changer 120 according to the present invention. In other words, as the coupling interfaces 16, 76 comply with industry standard electrical and mechanical specifications, the electrical connectors 10, 70 need not be utilized as a matched set. Where the flexibility of changing the position of a cable interface 30, 90 with respect to the electrical connector bracket 12, 72 is not required or desired on either the master unit 122 or tool unit 124 in any given application, the corresponding electrical connector 10, 70 according to the present invention may be substituted by a prior art fixed electrical connector that complies with the interface standard.

Figure 6:
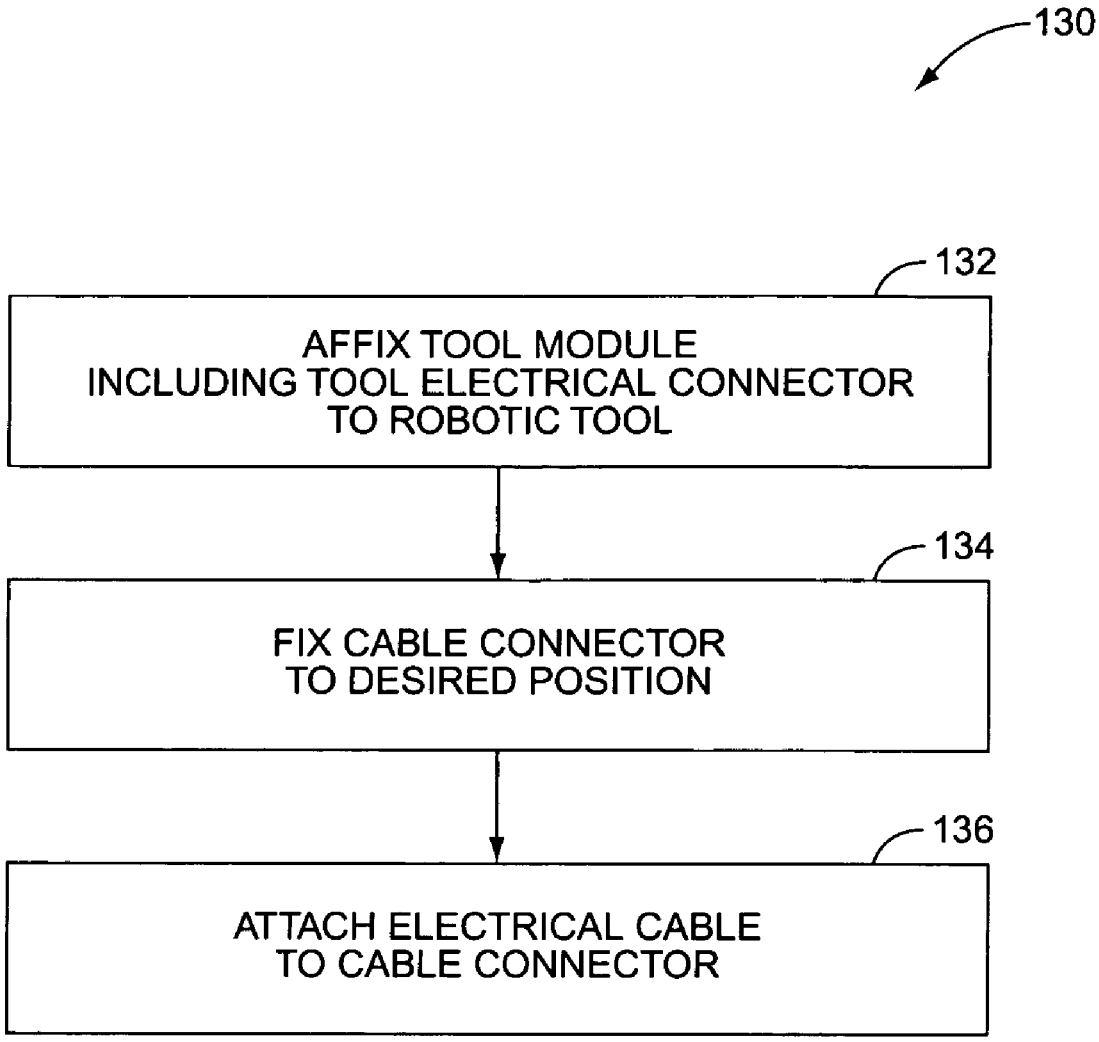
FIG. 6 is a flow diagram of a method of configuring a robotic tool.

In most robotic applications, a single master module 122 affixed to a robotic arm will interface with a broad variety of tool modules 124, each affixed to a different robotic tool. Hence, the present invention is likely to find its greatest utility in the use of at least the tool electrical connector 70. A method of configuring a robotic tool for use on a robotic arm, the robotic arm having a master module 122 and appropriate electrical connector attached thereto, is depicted in FIG. 6 and indicated generally by the number 130. A tool module 124 including a tool electrical connector 70 according to the present invention is affixed to the robotic tool, at step 132. The cable connector 94 is then fixed at a desired position to facilitate routing of electrical cables on the robotic tool, at step 134. This may comprise, for example, retracting a position-fixing retention member, rotating the cable interface 90 to the desired position, and re-inserting the position-fixing retention member, mating it with the selected position-fixing recess in the rotatable block 92 of the cable interface 90. The robotic tool electrical cable is then connected to the cable connector 94, at step 136. A directly analogous method is followed to configure a robotic arm to route the robotic arm electrical cable and connect it to the master module 122.

According to the present invention, a tool connector 10, 70 affixed to a master module 122 and/or tool module 124 of a robotic tool changer 120 may be configured to orient a cable interface 30, 90 in a desired position. This flexibility may alleviate maintaining an inventory of variously configured electrical connectors, and the requirement of removing one electrical connector and installing a differently configured electrical connector in its stead as the robotic operation and configuration is changed.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A multi-position electrical connector for a robotic tool changer, comprising:

a bracket mountable to a robotic tool changer master or tool module;

a coupling interface connected to said bracket, in a fixed position with respect to said bracket, said coupling interface comprising a plurality of electrical contacts; and a cable interface connected to said bracket, moveable to a plurality of discrete positions with respect to said bracket, said cable interface comprising a plurality of electrical contacts.

2. The connector of claim 1 wherein at least one said coupling interface electrical contact is electrically connected to a cable interface electrical contact.

3. The connector of claim 1 wherein said cable interface is disposed at substantially 90 degrees to said coupling interface.

4. The connector of claim 3 wherein said cable interface is rotatable about an axis of said coupling interface.

5. The connector of claim 4 wherein the plurality of discrete positions that said cable interface may assume, is disposed within a range of 180 degrees of rotation about said coupling interface axis.

6. The connector of claim 1 wherein said plurality of positions are predetermined.

7. The connector of claim 6 wherein said cable interface is fixed in one of said plurality of positions by the mating a retention member on one of said cable interface and said bracket, with a recess on the other of said cable interface and said bracket.

8. The connector of claim 7 wherein said retention member is a set screw inserted in a threaded through-hole in said bracket.

9. A robotic tool changer, comprising:

a master module having a master electrical connector affixed thereto via a first bracket; and a tool module having a tool electrical connector affixed thereto via a second bracket, said tool module adapted to be selectively coupled and decoupled to said master module;

wherein when said master and tool modules are coupled, said master and tool electrical connectors mate in an electrically conductive manner; and wherein one of said master and tool electrical connectors includes a cable connector moveable to a plurality of discrete positions.

10. The tool changer of claim 9 wherein said master and tool connectors comprise a plurality of electrical contacts, and wherein when said master and tool modules are coupled, a plurality of signals are connected between said master and tool connectors in an electrically conductive manner.

11. The tool changer of claim 9 wherein said cable connector is disposed at substantially 90 degrees to the axis of said master and tool electrical connectors when said connectors are mated.

12. The tool changer of claim 11 wherein said cable connector is rotatable about said axis.

13. The tool changer of claim 12 wherein said cable connector is held in one of said plurality of discrete positions about said axis by a retention member.

14. The tool changer of claim 13 wherein said retention member is a set screw.

15. A method of configuring a robotic tool for use on a robotic arm having a master module of a robotic tool changer including a master electrical connector attached thereto via a first bracket, comprising:

affixing a tool module to said robotic tool, said tool module including a tool electrical connector affixed thereto via a second bracket, and having a cable connector moveable to a plurality of discrete positions;

fixing said cable connector in one of said discrete positions; and attaching an electrical cable to said cable connector.

16. The method of claim 15 wherein fixing said cable connector in one of said discrete positions comprises moving said cable connector to one of a plurality of predetermined positions and securing said cable connector in the selected position.

17. The method of claim 16 wherein securing said cable connector in the selected position comprises engaging a retaining member in said second bracket in a recess of said cable connector.

18. The method of claim 17 wherein said retaining member is a set screw inserted in a threaded through-hole of said second bracket.

19. The method of claim 18 wherein said plurality of predetermined positions comprise a plurality of threaded through-holes positioned so as to engage a set screw with said recess as said cable connector is moved with respect to said second bracket.

20. An electrical connector, comprising:

a bracket;

a first multi-contact connector comprising a generally cylindrical pin block disposed in and secured to said bracket;

a second multi-contact connector electrically connected to said first connector and rotatably disposed in said bracket such that said second connector is rotatable around said first connector; and a retaining member disposed in said bracket operative to engage with one of a plurality of recesses in said second connector so as to fix said second connector in one of a plurality of predetermined positions around said first connector.

21. The connector of claim 20 wherein said plurality of predetermined positions is determined by said plurality of recesses in said second connector, each of which aligns with said retaining member as said second connector rotates around said first connector.

22. The connector of claim 20 wherein said retaining member is a set screw disposed in a threaded through-hole in said bracket.

23. The connector of claim 22 wherein said plurality of predetermined positions is determined by a plurality of threaded through-holes in said bracket, one of which contains a set screw and aligns with said recess in said second connector as said second connector rotates around said first connector.

* * * * *